US007931544B2

(12) United States Patent
Gill

(10) Patent No.: US 7,931,544 B2
(45) Date of Patent: Apr. 26, 2011

(54) IMPLEMENT GRIP ASSEMBLY WITH HARD CAP

(75) Inventor: David Keith Gill, Pinehurst, NC (US)

(73) Assignee: Eaton Corporation, Cleveland, OH (US)

( * ) Notice: Subject to any disclaimer, the term of this patent is extended or adjusted under 35 U.S.C. 154(b) by 127 days.

(21) Appl. No.: 12/413,762

(22) Filed: Mar. 30, 2009

(65) Prior Publication Data

US 2010/0248857 A1 Sep. 30, 2010

(51) Int. Cl.

| | |
|---|---|
| ***A63B 53/14*** | (2006.01) |
| ***A63B 49/08*** | (2006.01) |
| ***A63B 59/00*** | (2006.01) |
| ***B25G 1/00*** | (2006.01) |

(52) U.S. Cl. ..... 473/300; 473/549; 473/568; 81/492

(58) Field of Classification Search ..... 473/300–303, 473/549–552, 568, 282, 285–286, 294–297; D21/756; D8/DIG. 6, DIG. 7, DIG. 8; 74/551.9; 81/492; 16/DIG. 18, DIG. 19, DIG. 12, DIG. 24, 16/421, 430; 280/821

See application file for complete search history.

(56) References Cited

U.S. PATENT DOCUMENTS

| | | | | |
|---|---|---|---|---|
| 702,763 | A * | 6/1902 | Aurness | 74/551.9 |
| 886,889 | A * | 5/1908 | Stokes | 74/551.9 |
| 1,557,853 | A * | 10/1925 | Lipscomb | 81/492 |
| 2,772,090 | A * | 11/1956 | Brandon | 473/301 |
| 3,964,340 | A * | 6/1976 | Antonio et al. | 74/551.9 |
| 4,300,702 | A * | 11/1981 | Scharrer | 220/295 |
| 5,145,171 | A * | 9/1992 | Head et al. | 473/300 |
| 5,364,102 | A * | 11/1994 | Appledorn | 473/297 |
| 6,112,618 | A * | 9/2000 | Yates | 74/551.9 |
| 6,308,590 | B1 * | 10/2001 | Berto | 74/551.8 |
| 6,561,058 | B1 * | 5/2003 | Steinke | 74/551.9 |
| 7,399,235 | B2 * | 7/2008 | Gill et al. | 473/297 |
| 2003/0236129 | A1 * | 12/2003 | Pettinga et al. | 473/286 |

FOREIGN PATENT DOCUMENTS

| | | |
|---|---|---|
| EP | 0 315 423 A1 | 5/1989 |
| GB | 1 194 124 A | 6/1970 |

OTHER PUBLICATIONS

Piotr Swiderski, International Search Report and Written Opinion for PCT/B2010/000719, completed Jul. 14, 2010, 10 pages, European Patent Office, Rijswijk, The Netherlands.

* cited by examiner

*Primary Examiner* — Stephen L. Blau
(74) *Attorney, Agent, or Firm* — Fay Sharpe LLP

(57) ABSTRACT

An implement grip assembly with an open ended tubular flexible grip assembled over a tubular implement handle. An end cap with deflectable portions is inserted in the open end of the handle and the deflectable portions frictionally engage the tubular handle for retention. The cap may also have surfaces detentably engaging corresponding surfaces on the flexible grip. A decorative medallion may be received on the cap and frictionally or magnetically retained thereon.

16 Claims, 5 Drawing Sheets

IMPLEMENT GRIP ASSEMBLY WITH HARD CAP

BACKGROUND

The present disclosure relates to flexible grip assemblies for implements such as those used on sporting goods, as for example, golf clubs and tennis racquets, and tools such as hammers and shovels and other devices which are gripped and moved rapidly such as by a swinging movement by the user. Flexible grips for such implements are commonly provided on implement handles which have a tubular configuration and are fabricated by molding, such as for example, from elastomeric material. The molded grip is then assembled over the end of the tubular implement handle. Some grips are molded with a closed end tubular configuration such that the end of the implement tubular handle is not exposed when the grip is assembled thereover. However, the cost and complexity of molding closed end grips may be prohibitive for a particular application. Therefore, the flexible implement grip may be molded in a tubular configuration with opposite ends open to thereby simplify, facilitate and reduce the cost of the molded grips.

Where an open ended flexible molded grip is utilized for an implement handle, one technique for closing the opened end is that of inserting a relatively hard cap over the end of the tubular handle and flexible grip to provide closure thereof. However, problems have been encountered in providing a relatively low cost hardened cap for the end of the grip and tubular handle which may be inserted and retained frictionally, without the need for adhesives or secondary retaining and withstand the shock and flexure of the handle and grip assembly during usage.

Thus, it has been desired to provide a way or means of providing a flexible grip on an implement handle of the open ended variety and provide a closure cap thereon which is low in cost, easy to install and sufficiently robust in its attachment to remain in place on the implement during hard usage.

BRIEF DESCRIPTION

The present disclosure provides an implement grip assembly with a flexible elastomeric tubular grip assembled over a tubular implement handle; and, a relatively hard end cap is inserted in the open end of the tubular implement handle and frictionally retained thereon. The cap may have deflectable portions thereon which deflect to provide frictional engagement forces with the interior and exterior of the implement handle. The cap also may have surfaces thereon for detentably engaging the flexible grip such as, for example, an annular rib engaging an annular groove. If desired, the cap may have a decorative medallion attached thereto.

The engagement of the cap with the inner and outer surfaces of the implement tubular handle and the detentable engagement with the flexible grip provide adequate retention forces to maintain the cap in place when subjected to severe shock loading in service on the implement.

DETAILED DESCRIPTION

Figures 1A, 1B:
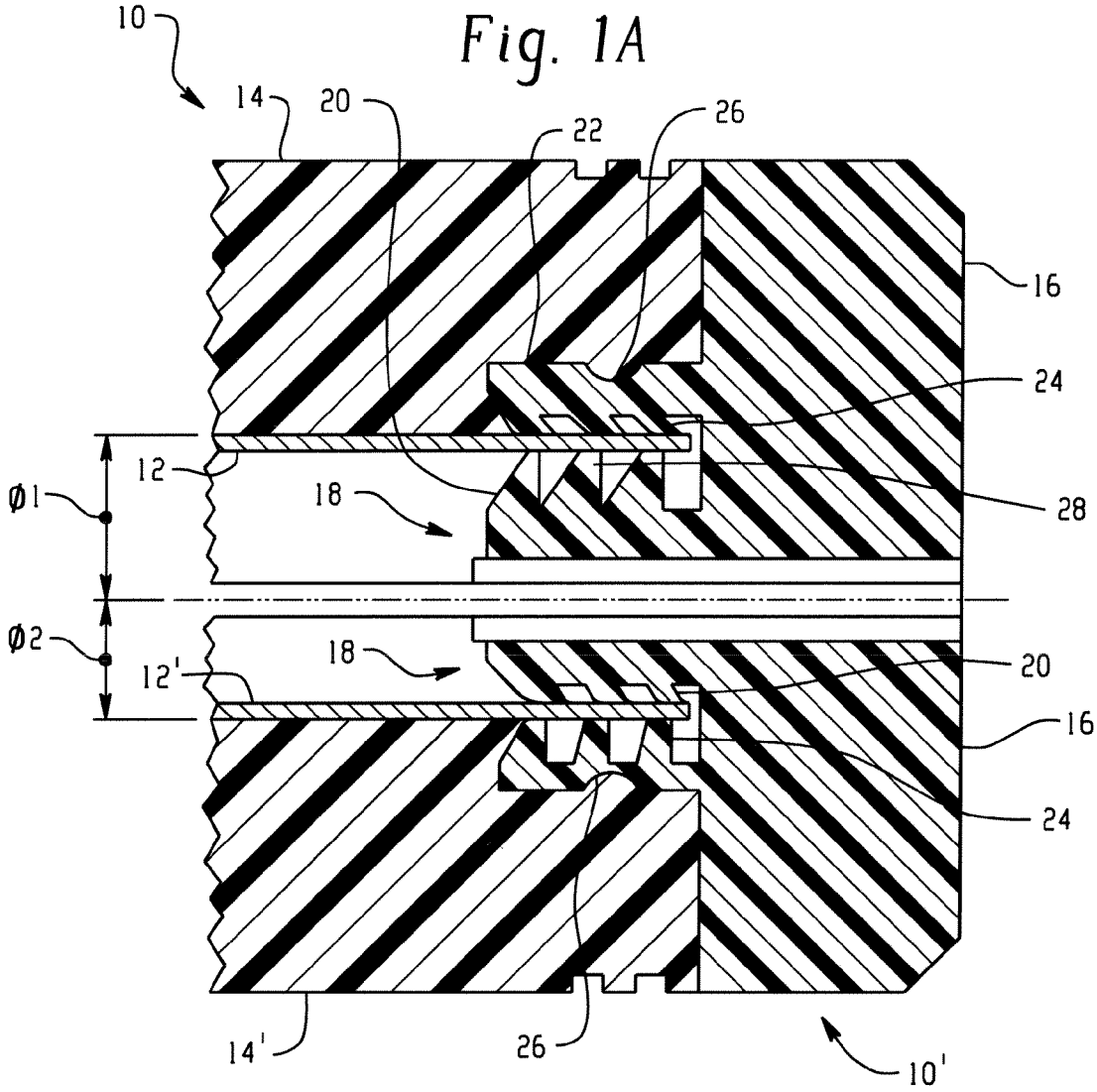
FIG. 1A is a cross-section of a grip assembly having a tubular implement handle with a flexible tubular grip thereon with an end cap having deflectable portions engaging the exterior of the tubular implement handle having a certain diameter ϕ1.
FIG. 1B is a view similar to FIG. 1A showing the end cap engaging the interior of a tubular implement handle of a smaller diameter ϕ2 with the end cap having other portions detentably engaging the interior of the flexible grip.

Referring to FIGS. 1A and 1B, one version of the grip assembly of the present disclosure is illustrated generally at 10 and includes an implement handle of tubular configuration denoted by reference numeral 12 in FIG. 1A and of a first diameter ϕ1 and in FIG. 1B denoted 12' as having a slightly smaller diameter ϕ2. The handle 12 has an open ended tubular grip 14 formed of elastomeric material received thereover; whereas, similarly the handle 12' in FIG. 1B has grip 14' received thereover.

An end cap member indicated generally at 16 has a large diameter portion configured to extend to the outer periphery of the grip 14, 14'; and, the cap 16 has a reduced diameter portion indicated generally at 18 which is configured to interfit and extend into the inner diameter of the tube 12 in FIG. 1A and the cap 16 has deflectable portions 18 in the form of a plurality of axially spaced annular barbs 20 formed thereon which are sized to frictionally interfit the inner periphery of the tubular handle 12 of diameter ϕ1.

In addition, the cap 16 has another cylindrical hub or extension 22 formed thereon having the plurality of radially inwardly extending annular barbs 24 which deflect and frictionally engage the outer periphery of the implement handle 12 in a highly compressed or deflected state as indicated in FIG. 1A. The outer periphery of the extension 22 has portions thereof configured for detentably engaging corresponding surfaces on the inner periphery of the grip 14 as denoted by reference numeral 26 and comprising, for example, a groove in the portion 22 having a corresponding annular rib 28 formed on the inner periphery of the grip 14 for detentably engaging the groove 26.

Referring to FIG. 1B, the barbs 20 on the reduced diameter portion 18 are shown fully deflected upon insertion into the smaller diameter tube 12'; and, the barbs 24 are shown relaxed but still frictionally engaging the outer periphery of the smaller diameter tube 12'. The hub or axial extension 22 retains the groove 26 for detentably engaging the grip 14'. Thus, cap 16 with a single molded configuration of the barbs 20, 24 can accommodate tubes of different sizes. In the present practice, in one version, diameter ϕ1 is in the range of about 15.7 mm and the diameter ϕ2 is in the range of about 14.2 mm. It will be understood however that other diameters may be employed. In the present practice, it has been found satisfactory to have the ratio of the maximum diameter to the minimum diameter for satisfactory engagement of the cap in the range of about 1.1.

Figures 2A, 2B:
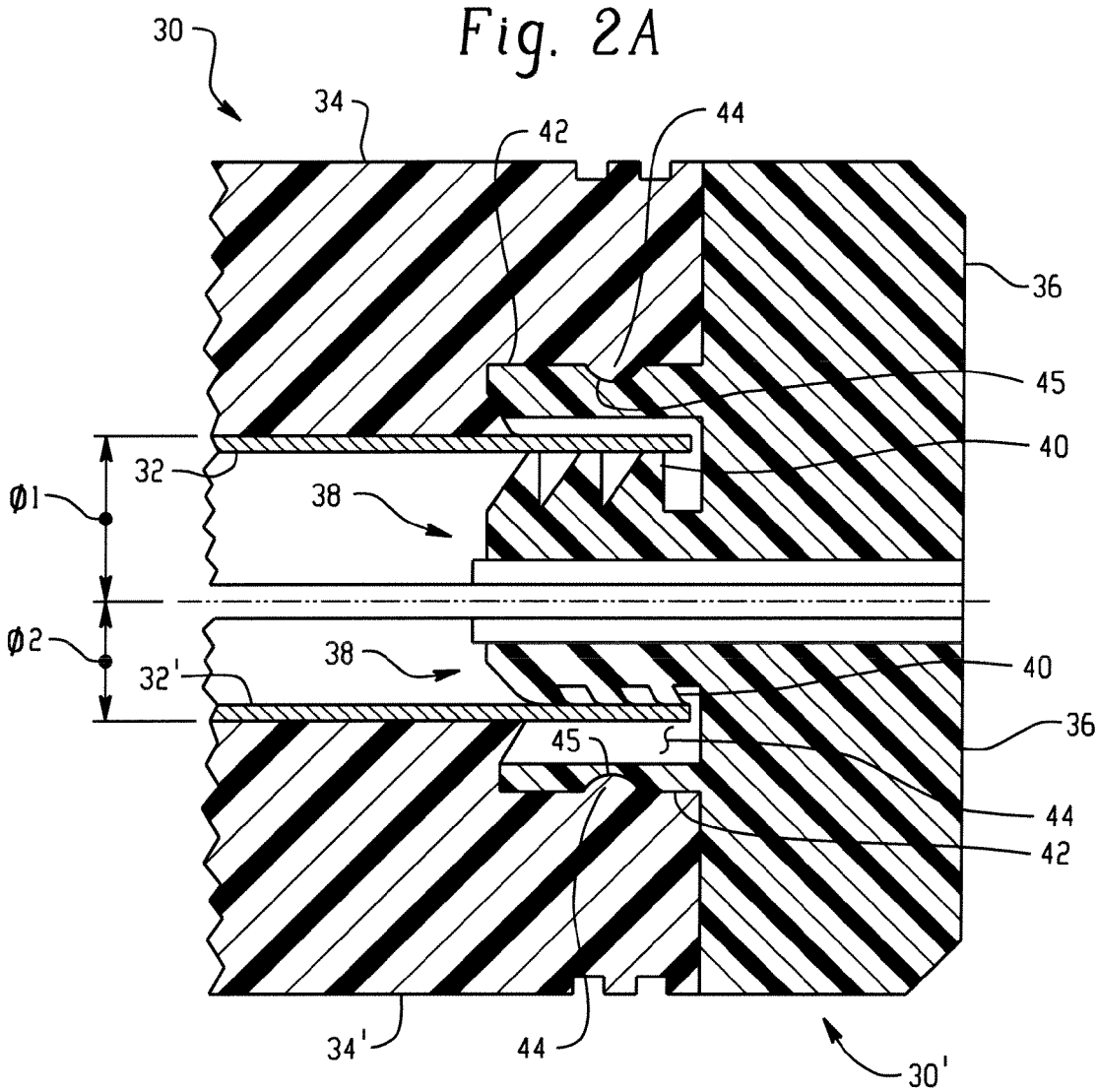
FIG. 2A is a view similar to FIG. 1A showing in cross-section a grip assembly having a tubular handle with flexible tubular grip thereover and an end cap with a deflectable portion engaging the interior of the implement handle with a first deflection for a given diameter ϕ1 and other portions detentably engaging the interior of the flexible grip.
FIG. 2B is a view similar to FIG. 1B showing the deflectable portions of FIG. 2A with a second further deflection to frictionally engage the inner periphery of a tube of smaller diameter ϕ2 with the other portions continuing to detentably engage the inner periphery of the grip.

Referring to FIGS. 2A and 2B, another version of the grip assembly of the present disclosure is indicated generally at 30 and is shown assembled onto an implement handle 32 of a first diameter C1 in FIG. 2A and onto an implement handle 32' of a second slightly diameter C2 in FIG. 2B. The implement handle 32 has an elastomeric grip of tubular form denoted by reference numeral 34 received thereover. An end cap 36 with a hub indicated generally at 38 is provided having a reduced diameter provided thereon, the hub having a plurality of axially spaced annular barbs 40 which frictionally engage the interior of the tubular handle 32. The end cap 36 also has another axially extending hub portion 42 provided thereon which surrounds concentrically hub 38 and is configured to be received over the outer diameter of tube 32. The hub 42 has surfaces 44 provided on the outer periphery thereof for detentably engaging corresponding surfaces provided on the interior of the elastomeric grip 34. In the present practice, the grip 34 has a radially inwardly extending annular rib 45 formed thereon for inter-engaging in detentable fashion the groove 44.

Referring to FIG. 2B, a similar grip 34' is sized to interfit over the outer periphery of the implement handle 32' having the outer diameter ϕ2; and, the barbs 40 on hub 38 are further deflected from the position shown in FIG. 2A for frictional engagement of the inner periphery of the tube 32'. The hub 42 having been sized for the tube 32 of diameter ϕ1 thus leaves an annular space 44 about the outer periphery of the tube 32'. In the present practice, the tube diameters ϕ1, ϕ2 of the version illustrated in FIGS. 2B and 2B may have the same ranges and dimensions as those hereinabove described with respect to FIGS. 1A and 1B.

Figure 3A:
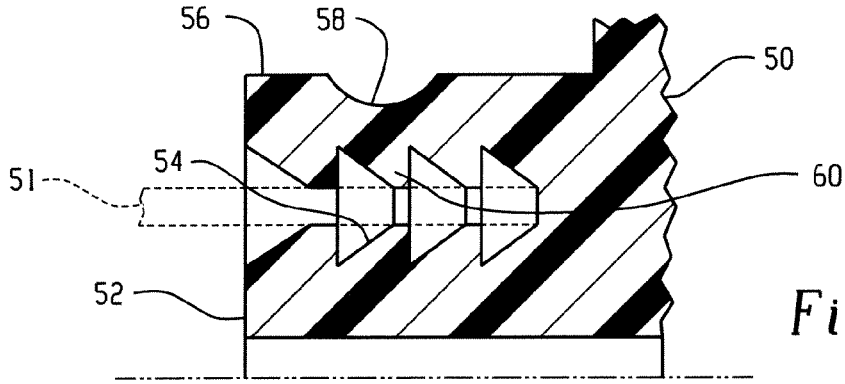
FIG. 3A is a cross-section of a portion of an end cap for a grip assembly having deflectable portions formed therein for engaging the interior and exterior surfaces of a tubular implement handle and an annular groove for detentably engaging the flexible grip.

Referring to FIG. 3A, another version of an end cap 50 shown for assembly over a tubular implement handle, shown in dashed line and denoted 51, is illustrated wherein the inner hub 52 of the cap has a plurality of annular barbs 54 formed thereon for frictionally engaging the inner periphery of the tubular implement handle 51; and, the cap 50 has a concentrically outer hub 56 with an annular groove 58 formed therein for detentably engaging a corresponding surface on an elastomeric grip (not shown). The outer hub 56 has a plurality of radially inwardly extending annular barbs 60 formed on the inner periphery thereof for the frictionally engaging by deflection the outer periphery of the tubular implement handle 51.

Figure 3B:
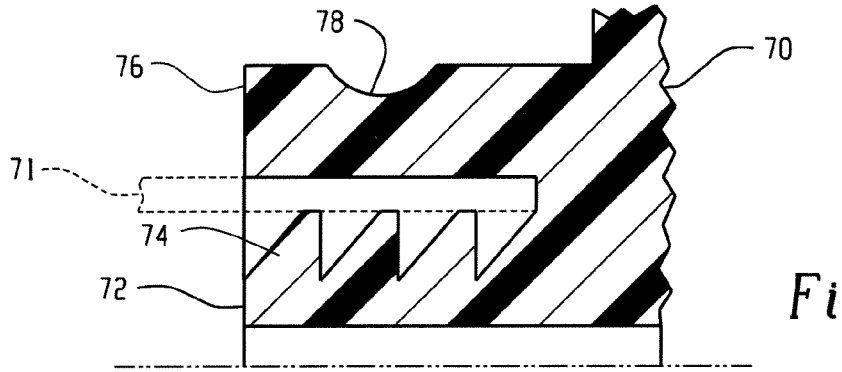
FIG. 3B is a view similar to FIG. 3A of another version of an end cap having deflectable portions formed thereon for engaging the inner periphery of a tubular implement handle and an annular groove for detentably engaging the flexible grip.

Referring to FIG. 3B, another version of the cap for a flexible implement grip assembly is indicated at 70 with an implement handle of tubular configuration indicated in dashed outline and denoted by reference numeral 71. The cap 70 has an inner hub 72 extending axially therefrom with a plurality of annular barbs extending radially outwardly therefrom as denoted by reference numeral 74, which barbs are operative for deflection and frictional engagement in the inner periphery of the tubular implement handle 71. The cap 70 also has a concentric outer annular hub 76 which has the inner periphery thereof sized for engaging the outer surface of the tubular implement handle 71. A groove 78 is provided annularly about the outer periphery of the hub 76 for detentably engaging corresponding surfaces on the inner periphery of a flexible elastomeric grip (not shown).

Figure 3C:
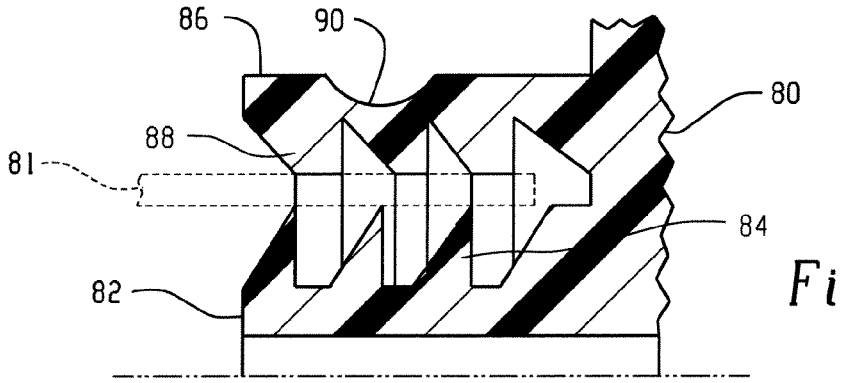
FIG. 3C is a view similar to FIG. 3A illustrating another version of an end cap having staggered deflectable portions formed thereon for engaging the inner periphery and outer periphery of a tubular implement handle and an annular groove for detentably engaging a flexible grip.

Referring to FIG. 3C, another version of the cap 80 is shown for a tubular implement handle, illustrated in dashed line and indicated by reference numeral 81; and, cap 80 has an inner hub portion 82 extending axially therefrom with a plurality of spaced annular radially outwardly extending barbs 84 formed thereon which are deflectable and configured for frictionally engaging the inner surface of the tubular implement handle 81. The cap 80 also has an outer annular concentric hub portion 86 which has a plurality of radially inwardly extending annular barbs 88 for deflectably and frictionally engaging the outer surface of the tubular implement handle 81; and, in the version of FIG. 3C, the barbs 88 and 84 are staggered axially. Hub 86 includes an annular groove 90 on the outer periphery thereof for detentably engaging a corresponding surface on an inner periphery of the elastomeric grip (not shown).

Figure 3D:
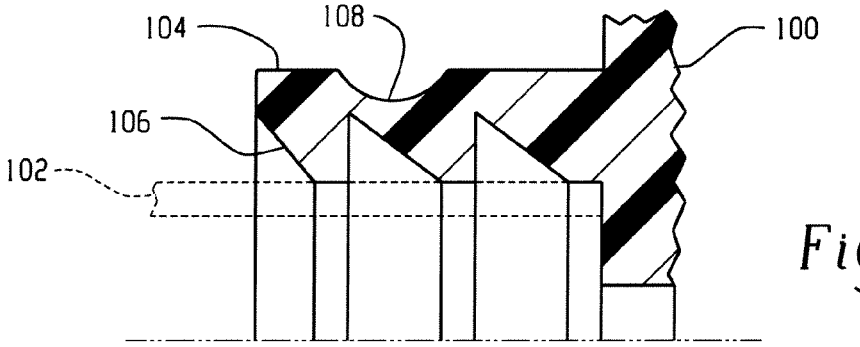
FIG. 3D is a view similar to FIG. 3A of another version of an end cap for a grip assembly having deflectable portions thereon for engaging the outer periphery of a tubular implement handle and an annular groove for detentably engaging a flexible grip therefor.

Referring to FIG. 3D, another version of a cap 100 for a grip assembly is shown for use with a tubular implement handle illustrated in dashed outline denoted by reference numeral 102. Cap 100 has an axially extending annular hub 104 which is sized and configured for assembly over the outer periphery of the tubular handle 102. Hub 104 has formed on the inner periphery thereof a plurality of axially spaced radially inwardly extending annular deflectable ribs 106; and, the hub 104 also includes an annular groove 108 formed in the outer periphery thereof for detentably engaging a correspondingly configured rib provided on the inner periphery of the elastomeric grip (not shown). Although the barbs 106 of cap version 100 frictionally engage the tubular implement handle 102 only on its outer periphery, the cap 100 has the advantage of being less complex, simpler to manufacture and less costly.

Figures 4A, 4B:
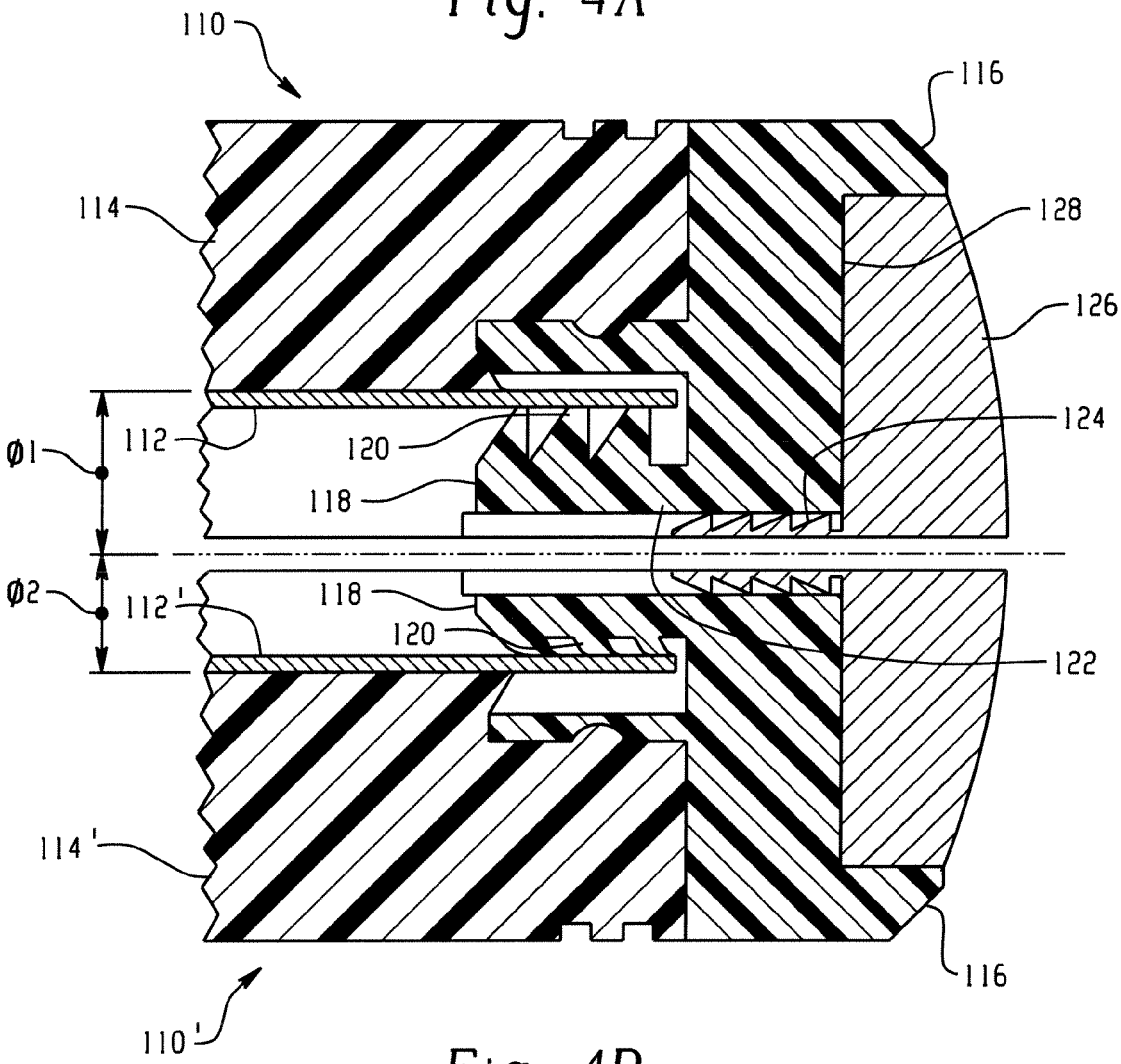
FIG. 4A is a cross-section of a portion of a grip assembly for an implement handle having a flexible grip with an end cap engaging the interior surfaces of the tubular handle of a certain diameter ϕ1 and detentably engaging the flexible grip with a medallion frictionally engaging a bore in the end cap.
FIG. 4B is a view similar to FIG. 4A showing the deflectable portions further deflected for engaging a tubular handle of a smaller diameter ϕ2.

Referring to FIGS. 4A and 4B, another version of a grip assembly of the present disclosure is indicated generally at 110 and has a tubular implement handle 112 of a first diameter ϕ1 in FIG. 4A and a tubular implement handle 112' in FIG. 4B of a second smaller diameter ϕ2.

The grip assembly 110 includes an open ended tubular grip 114, 114' received respectively over the tubular implement handle 112, 112' in frictional engagement therewith. An end cap 116 is fitted over the end of the grip and tubular handle 112, the cap 116 having a reduced diameter hub portion 118 extending axially therefrom and into the interior of the tubular handle 112, 112'. The hub 118 is a common size for both tubular elements of diameters ϕ1, ϕ2; and, the hub 118 has a plurality of axially spaced radially outwardly extending annular deflectable barbs 120 formed about the outer periphery of the hub and operative for frictionally engaging the inner periphery of the implement handle 112, 112'. In FIG. 4A, the barbs are shown as minimally deflected and frictionally engaging the inner periphery of tube 112 of diameter ϕ1; and, in FIG. 1B, the barbs 120 are shown significantly further deflected and frictionally engaging the inner periphery of the tube 112' of the smaller diameter ϕ2. Thus, the barbs on hub 118 may be employed for engaging tubular implement handles of different diameters ϕ1, ϕ2.

Cap 116 has a central bore 122 into which is received in frictional engagement annular barbs 124 formed on a reduced diameter portion of a medallion insert 126 which is received in a recess 128 formed in the end of cap 116. The medallion 126 may have decorative indicia provided on the outer face thereof if desired.

Figures 5A, 5B:
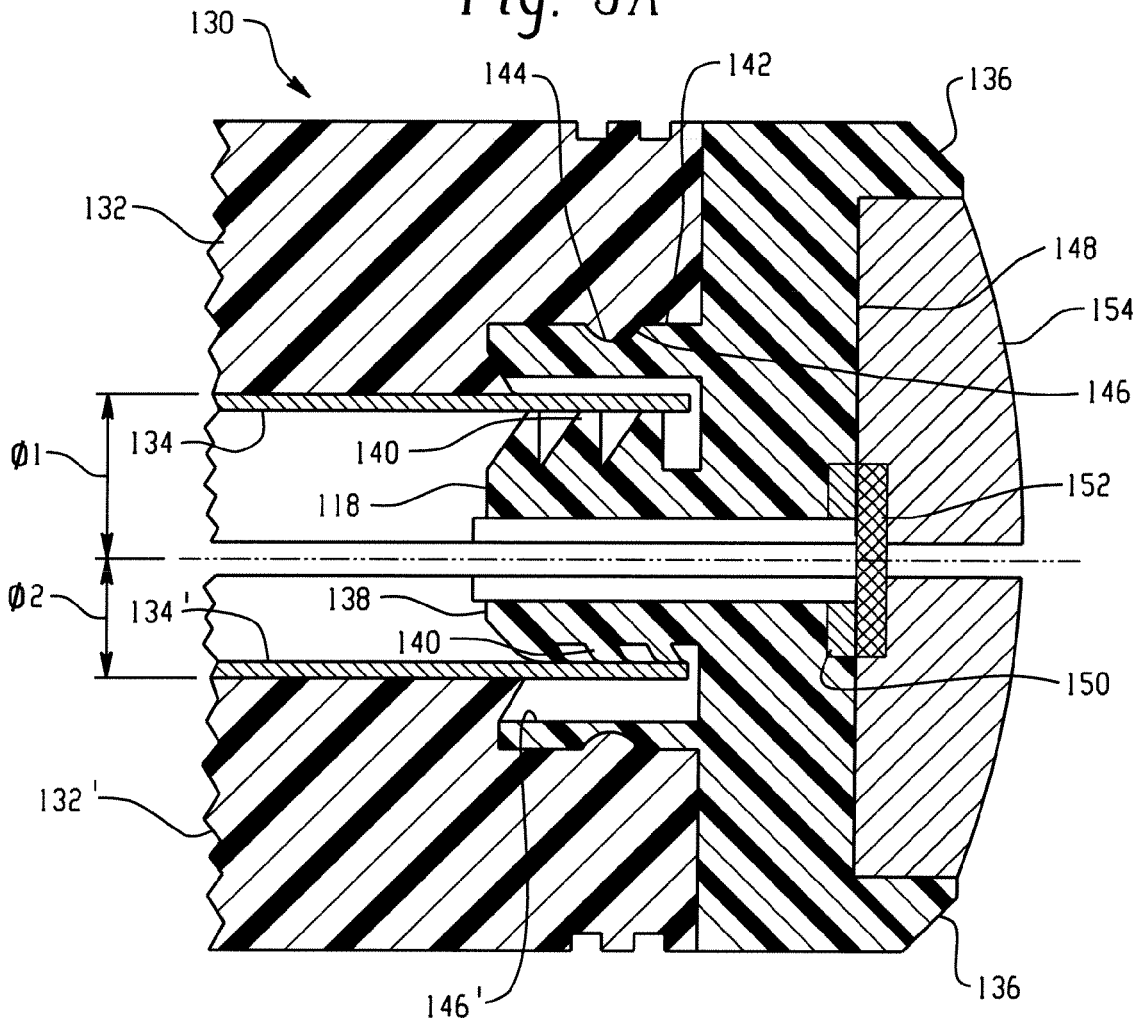
FIG. 5A is a view of another version of the end cap for a flexible grip assembly for a tubular implement handle with deflectable portions engaging the interior of the tube of diameter ϕ1 with the end cap having a medallion retained thereon by magnetic attraction of magnetically permeable material; and, FIG. 5B is a view similar to FIG. 5A showing the deflectable portions further deflected for engaging a tubular handle of a smaller diameter ϕ2.

Referring to FIGS. 5A and 5B, another version 130 of a flexible grip assembly for an implement is indicated generally at 130 and has an elastomeric tubular open ended grip 132 received over the outer periphery in frictional engagement of a tubular implement handle 134 of diameter ϕ1 as shown in FIG. 5A and also over a tubular implement handle 134' of a lesser diameter ϕ2 as shown in FIG. 5B.

An end cap 136 is provided over the end of the grip 132, 132'; and, cap 136 has a reduced diameter hub 138 extending axially therefrom and which has a plurality of axially spaced radially outwardly extending deflectable annular ribs 140 formed thereon which are shown minimally deflected in frictional engagement with the inner periphery of the implement handle 134 having diameter ϕ1 in FIG. 5A. The ribs 140 are shown fully deflected in frictional engagement with the inner periphery of tubular implement handle 134' of a lesser diameter ϕ2 in FIG. 5B.

Cap 136 also has a concentric outer hub 138 formed thereon with the inner surface thereof sized and engaged for receipt over the outer periphery of the tube 134. Hub 138 is provided with an annular groove 144 for detentably engaging a correspondingly configured annular rib 146 provided on the inner periphery of the grip 132 and with correspondingly configured rib 146' provided on the inner periphery of the grip 132'.

Cap 136 has a recess 148 formed therein on the outer face thereof which recess has magnetically permeable material disposed therein as denoted by reference numeral 150; and, corresponding magnetically permeable material 152 is provided on the inner face of a medallion 154 received in recess 148. The medallion 154 may be readily removed and may have decorative indicia thereon if desired. The magnetic retention of medallion 154 thus renders it interchangeable for different indicia.

The present invention thus provides a unique flexible grip assembly for an implement having a tubular handle with an open ended elastomeric grip provided thereon and with an end cap frictionally engaging surfaces of the tubular handle and detentably engaging surfaces of the elastomeric grip for secure retention thereon.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An implement grip assembly comprising:

(a) a substantially rigid tubular handle member;

(b) a tubular cover of flexible material received over the handle member proximate an end thereof; and, (c) an end cap disposed over the end of the tubular handle and cover, the end cap having deflectable portions integrally formed therewith frictionally engaging the inner surface of the tubular handle, wherein the cap has other portions integrally formed therewith detentably engaging corresponding surface portions formed on the inner periphery of the tubular cover.

2. The implement grip assembly defined in claim 1, wherein the tubular cover is formed of elastomeric material; and, the cap is formed of plastic material.

3. The implement grip assembly defined in claim 1, wherein the deflectable portions comprise a helical rib.

4. The implement grip assembly defined in claim 1, wherein the deflectable portions comprise a plurality of spaced annular barbs.

5. The implement grip assembly defined in claim 1, further comprising an additional plurality of deflectable portions formed integrally therewith said cap, the additional portion frictionally engaging the outer surface of the tubular handle.

6. The implement grip assembly defined in claim 1, wherein the cap has a centrally located aperture; and, a medallion received thereon with portions of the medallion received in and frictionally engaging the aperture for retaining the medallion on the cap.

7. The implement grip assembly defined in claim 6, wherein the portions frictionally engaging include a plurality of spaced annular ribs.

8. The implement grip assembly defined in claim 1, wherein the cap includes magnetically permeable material and a medallion is disposed on the cap and retained thereon by magnetic attraction with the magnetically permeable material.

9. The implement grip assembly defined in claim 1, wherein the tubular handle member is formed of one of (i) steel and (ii) graphite material.

10. The assembly defined in claim 1, wherein the other portions detentably engaging the cover include one of an annular rib formed on the cap and an annular groove formed in the cap.

11. The assembly defined in claim 10, wherein the cover includes one of a corresponding annular rib and annular groove.

12. The assembly defined in claim 1, wherein the cap includes a recess on the outer surface thereof with a medallion bonded thereto.

13. The assembly defined in claim 12, wherein the medallion is adhesively bonded.

14. The assembly defined in claim 1, wherein the plurality of deflectable portions are sized for frictional engagement with a tubular handle member of a first inner diameter; and, said deflectable portions are capable of additional deflection for frictional engagement with a tubular handle having a second diameter significantly less than the first diameter.

15. The assembly defined in claim 14 wherein the second inner diameter is in the range of about ninety percent (90%) of the first inner diameter.

16. The assembly defined in claim 1, wherein the deflectable portions and the said other portions are molded with the cap.

* * * * *